US005245922A

United States Patent [19]

Klemm

[11] Patent Number: 5,245,922

[45] Date of Patent: Sep. 21, 1993

[54] SCREEN PRINTING MACHINE WITH COMPUTERIZED SCREEN ADJUSTING MECHANISM

[75] Inventor: Gerhard Klemm, Bielefeld, Fed. Rep. of Germany

[73] Assignee: Gerhard Klemm Maschinenfabrik GmbH & Co., Bielefeld, Fed. Rep. of Germany

[21] Appl. No.: 800,934

[22] Filed: Nov. 26, 1991

[30] Foreign Application Priority Data

Nov. 27, 1990 [DE] Fed. Rep. of Germany ..... 4037678

[51] Int. Cl.[5] ..... B41F 15/10

[52] U.S. Cl. ..... 101/115; 101/126

[58] Field of Search ..... 101/123, 124, 126, 129, 101/115, 485, DIG. 36, 481, 486, 114

[56] References Cited

U.S. PATENT DOCUMENTS

| | | | |
|---|---|---|---|
| 4,242,957 | 1/1991 | Mascioni et al. | 101/126 |
| 4,249,688 | 2/1981 | Klemm | 226/24 |
| 4,510,864 | 4/1985 | Klemm | 101/123 |
| 4,516,495 | 5/1985 | Ericsson | 101/129 |
| 4,589,336 | 5/1986 | Klemm | 101/124 |
| 4,610,200 | 9/1986 | Metso | 101/126 |
| 4,628,814 | 12/1986 | Klemm | 101/123 |
| 4,945,829 | 8/1990 | Ericsson | 101/129 |
| 4,953,459 | 9/1990 | Ericsson | 101/129 |
| 4,964,335 | 10/1990 | Klemm | 101/126 |
| 4,964,335 | 10/1990 | Klemm | 101/129 |

FOREIGN PATENT DOCUMENTS

| | | |
|---|---|---|
| 0259776 | 9/1987 | European Pat. Off. . |
| 0311729 | 4/1989 | European Pat. Off. . |
| 3015159 | 11/1980 | Fed. Rep. of Germany . |
| 3707866 | 10/1987 | Fed. Rep. of Germany . |

*Primary Examiner*—J. Reed Fisher
*Attorney, Agent, or Firm*—Peter K. Kontler

[57] ABSTRACT

A screen printing machine with one or more printing units each of which has a screen and at least one squeegee above a portion of the path for a movable web of paper or the like. The positions of the screens are adjustable by carriages which support the frames for the screens and receive motion from sets of motors which respond to signals from a computer. The latter receives signals from cameras which are adjacent the path of movement of the web and monitor alignment marks (if any) on the web and/or the position of printed matter on the web.

20 Claims, 2 Drawing Sheets

SCREEN PRINTING MACHINE WITH COMPUTERIZED SCREEN ADJUSTING MECHANISM

BACKGROUND OF THE INVENTION

The invention relates to screen printing machines in general, and more particularly to improvements in screen printing machines with movable screens.

It is already known to provide the single printing unit or each printing unit of a screen printing machine with a movable screen, one or more squeegees, a back support (e.g., a flat bed or a cylinder), a mechanism for transporting a web of paper, textile or other material along a predetermined path between the screen and the back support of each printing unit, and means for monitoring the positions of passer marks if the machine is a multicolor printing machine. Certain multicolor screen printing machines are constructed in such a way that the web advances from printing unit to printing unit to receive printed matter in two or more different colors. Alternatively, the web is rolled up after having been advanced through a first printing unit and is unrolled at a later time for advancement through another printing unit. The first outlined mode of operation is preferred at this time. A web which is provided with printed matter in two or more printing units is provided with passer marks (also called alignment marks or registration marks) which are monitored, and the thus obtained signals are utilized to effect appropriate adjustments of the web and to thus ensure the application of printed matter to predetermined portions of the web. Reference may be had, for example, to commonly owned U.S. Pat. No. 4,964,335 granted Oct. 23, 1990 for "Screen printing method" which describes and shows a machine with means for adjusting the position of a web in dependency on signals which are generated as a result of monitoring passer marks on the web. Applicators of passer marks are disclosed in commonly owned U.S. Pat. No. 4,510,864 granted Apr. 16, 1985 for "Screen printing machine" and in commonly owned U.S. Pat. No. 4,249,688 granted Feb. 10, 1991, "Device for intermittent feeding of webs" to which reference may be had, if necessary. Accurate positioning of the web in a multicolor printing machine is desirable and advantageous in order to ensure that each next-following application of printed matter takes place in exact accordance with a preselected pattern. This reduces the likelihood of undesirable shifting of margins which would entail the formation of improperly colored marginal prints.

Heretofore known procedures which involve reliance on passer marks for accurate positioning of the web relative to the screens of a multicolor printing machine necessitate a multi-stage displacement of the web including rapid advancement for coarse adjustment and much slower additional adjustment for precise positioning of the web prior to application of ink in the second, third, etc. printing unit of the machine. Thus, the machine must be provided with means for controlling the operation of the web advancing mechanism with a very high degree of accuracy and in a plurality of stages. If the multicolor screen printing machine is of the type wherein the web is caused to form loops between successive printing stations, the transporting mechanism is or can be designed to increase or reduce the sizes of the loops between successive printing units. If the just described multicolor printing machine employs counterpressure rollers or cylinders, rotation of the rollers at a higher or lower speed and/or through a larger or smaller angle will entail a change in the dimensions of the loop which is formed by the web of material to be provided with printed matter. A drawback of such proposals is that the tensional stresses upon the web as well as the slippage of the web relative to a counterpressure cylinder constitute two variables which are sufficiently unpredictable to appreciably affect the quality of the ultimate product. Therefore, the just outlined screen printing machines are not suitable for the application of printed matter with a very high degree of accuracy (e.g., in the micro range) such as is desirable, for example, in connection with the application of printed matter to circuit boards and the like.

German patent application No. 30 15 159 A1 of Ericsson (published Nov. 6, 1980) discloses a screen printing machine which is provided with optical sensors for detection of passer marks or color shifts. It has been found that such machines are incapable of ensuring highly accurate adjustments of the positions of screens and of the material to be printed relative to each other. On the other hand, the demand for highly accurate screen printing machines is on the increase, not only in connection with the application of printed matter for the purpose of making printed circuit boards but also for a number of other applications.

European patent application No. 0 259 776 of Amao et al. (published Mar. 16, 1988) discloses a screen printing machine wherein the position of the material to be printed can be adjusted in three different directions in response to signals which are generated in response to monitoring of passer marks or alignment marks. The monitoring means includes a camera which is installed for movement in a direction at right angles to the direction of advancement of the material to be printed.

German patent application No. 37 07 866 A1 of Roch et al. (published Oct. 1, 1987) discloses a method of and an apparatus for controlling and adjusting the components of a printing and cardboard making machine. The inventors propose to gather information from the components to be adjusted, to evaluate the thus obtained information, to store the information, to utilize the stored information for presentation in alphanumerical and graphical form, to display the information on a screen, and to manually contact the displayed information for the purpose of effecting adjustments of various components of the machine.

European patent application No. 0 311 729 A1 of Zimmer et al. (published Apr. 19, 1989) discloses a method of positioning cylindrical printing components in a machine with at least two printing stations. The positioning of cylindrical components is effected in response to monitoring of passer marks.

OBJECTS OF THE INVENTION

An object of the invention is to provide a novel and improved screen printing machine, particularly a multicolor screen printing machine, which is constructed and assembled in such a way that the unpredictabilities of the material to be printed have little or no effect upon the quality of the printed matter.

Another object of the invention is to provide a machine which is adjustable in a novel and improved way to ensure the application of ink with a high degree of accuracy.

A further object of the invention is to provide the machine with novel and improved means for monitoring the material to be printed.

An additional object of the invention is to provide the machine with novel and improved means for adjusting the screen or screens of a screen printing machine.

Still another object of the invention is to provide a novel and improved method of adjusting certain components of a screen printing machine in dependency upon information which is borne by the material to be printed.

A further object of the invention is to provide the machine with novel and improved means for changing the position and/or orientation of the screen or screens at the printing station or stations of a screen printing machine.

An additional object of the invention is to provide a machine which can be utilized with advantage for the application of printed matter with a degree of accuracy which is required in connection with the making of printed circuit boards and like products.

Another object of the invention is to provide a screen printing machine wherein the adjustments of two or more screens can be synchronized in a simple, inexpensive and reliable manner.

A further object of the invention is to provide novel and improved operative connections between the screens of a multicolor printing machine and the device or devices which serve to detect the presser marks or alignment marks on the material to be printed.

SUMMARY OF THE INVENTION

The invention is embodied in a screen printing machine wherein a web of paper, textile or other material to be printed is advanced in a predetermined direction along a predetermined path. The improved screen printing machine comprises at least one printing unit including a screen adjacent a predetermined portion of the path and disposed at one side of such path, means (e.g., one or more squeegees) for applying to the web ink by way of the screen, and adjustable means (e.g., a carriage for a frame which surrounds and carries the screen) for moving the screen relative to the path in at least one of a plurality of different directions including a first direction which substantially coincides with the predetermined direction, a second direction substantially counter to the predetermined direction, and at least one third direction substantially transversely of the predetermined direction. The machine further comprises signal generating means including at least one camera for monitoring at least one of a plurality of parameters including the positions of passer marks (if any) on the web relative to the path and the position of ink (i.e., of printed matter) on the web, signal generating evaluating means (e.g., including a computer) for evaluating signals from the monitoring means, and means for adjusting the moving means in response to signals from the evaluating means. The monitoring means can include a plurality of cameras, and the adjusting means can comprise at least one motor, e.g., a stepping motor.

The improved screen printing machine can further comprise at least one additional printing unit which is adjacent a second portion of the path upstream of the predetermined portion of such path. The at least one camera can be located downstream of the predetermined portion of the path. The camera can also be located upstream of the predetermined portion (for example, between the predetermined and second portions) of the path.

The machine with two or more printing units can further comprise means for coupling the moving means of the two or more units for simultaneous movement of all screens as well as of the web relative to the path. The coupling means can comprise a support for each of the moving means, a displacing member which connects the supports to each other, and means (e.g., a crank drive or an eccentric drive) for shifting the displacing member at least in or counter to the predetermined direction.

As mentioned above, the monitoring means can comprise at least one camera which can be installed upstream or downstream of the predetermined portion of the path.

The adjusting means preferably comprises a plurality of motors having output elements operatively connected with the carriage for the frame which surrounds the screen of the at least one printing unit. For example, the adjusting means can comprise a first motor having means for adjusting the moving means in the first direction, a second motor having means for adjusting the moving means in the second direction, and a third motor having means for adjusting the moving means in the at least one third direction. The moving means can be provided with an extension which is connected with the adjusting means of the third motor.

The evaluating means (as mentioned above, the evaluating means can include a computer) can be provided with means for comparing signals from the monitoring means with reference signals which denote the desired or optimum parameters and for generating signals for transmission to the adjusting means when the characteristics of signals from the monitoring means deviate from the characteristics of the reference signals. The signal comparing means can be designed to transmit signals to the aforementioned first and second motors, i.e., to the motors which serve to cause the moving means to move the screen in and counter to the predetermined direction.

The screen printing machine can further comprise one or more springs or other suitable means for biasing the moving means against the adjusting means, e.g., against the output element of at least one of the first and second motors.

The moving means can further include means for changing the orientation of the screen relative to the predetermined portion of the path. If the screen is disposed in a predetermined plane (e.g., in a substantially horizontal plane) the orientation changing means can be designed to angularly move the screen in such plane.

The novel features which are considered as characteristic of the invention are set forth in particular in the appended claims. The improved screen printing machine itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 5:
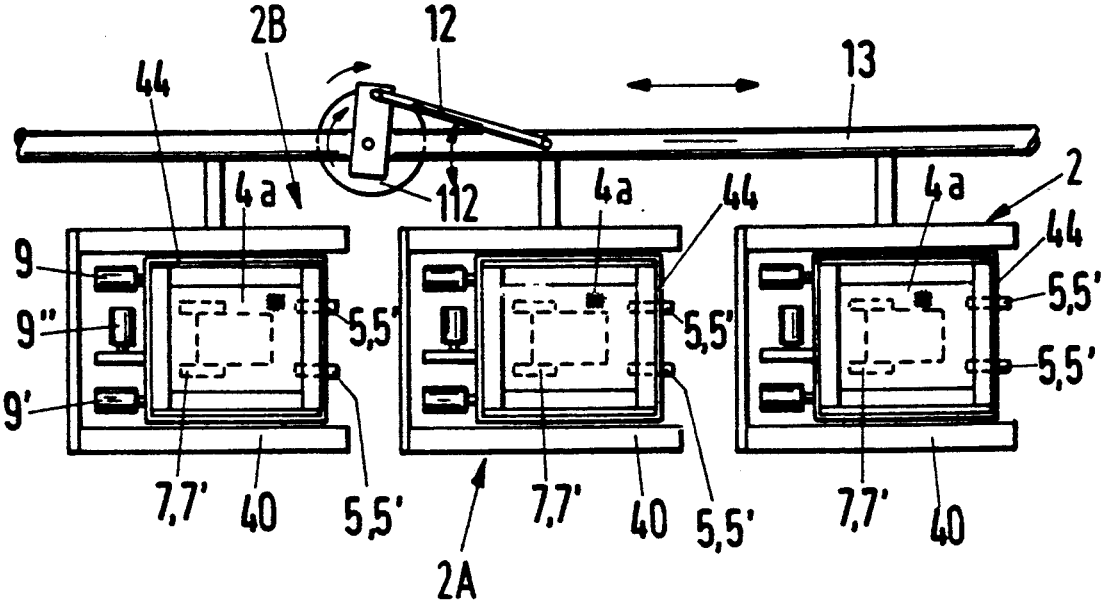
FIG. 5 is a smaller-scale plan view of a series of three aligned printing units and of means for coupling the moving means of the three units to each other.

The fully automated screen printing machine 1 which is shown in the drawing is designed to apply printed matter to a web 3 of paper or other material to be printed in a series of successive stages, namely in each of a series of three printing units 2, 2A and 2B (FIG. 5). If the web 3 is provided with passer marks (also called alignment marks or registration marks), the accuracy of application of such marks should be in the range of, for example, plus or minus 0.05 mm. Under certain special circumstances when the web 3 does not carry any passer marks, the monitoring of selected points of information on the web should be carried out with the same or with a similar degree of accuracy. This can be achieved by monitoring the position of printed matter which has been applied in the first printing unit 2, and the position of the screen 4a in the next printing unit 2A is adjusted accordingly (if and when necessary) to ensure that the position of printed matter which is to be applied in the unit 2A relative to the printed matter which has been applied in the unit 2 will match exactly the desired relationship between such imprints.

Figure 1:
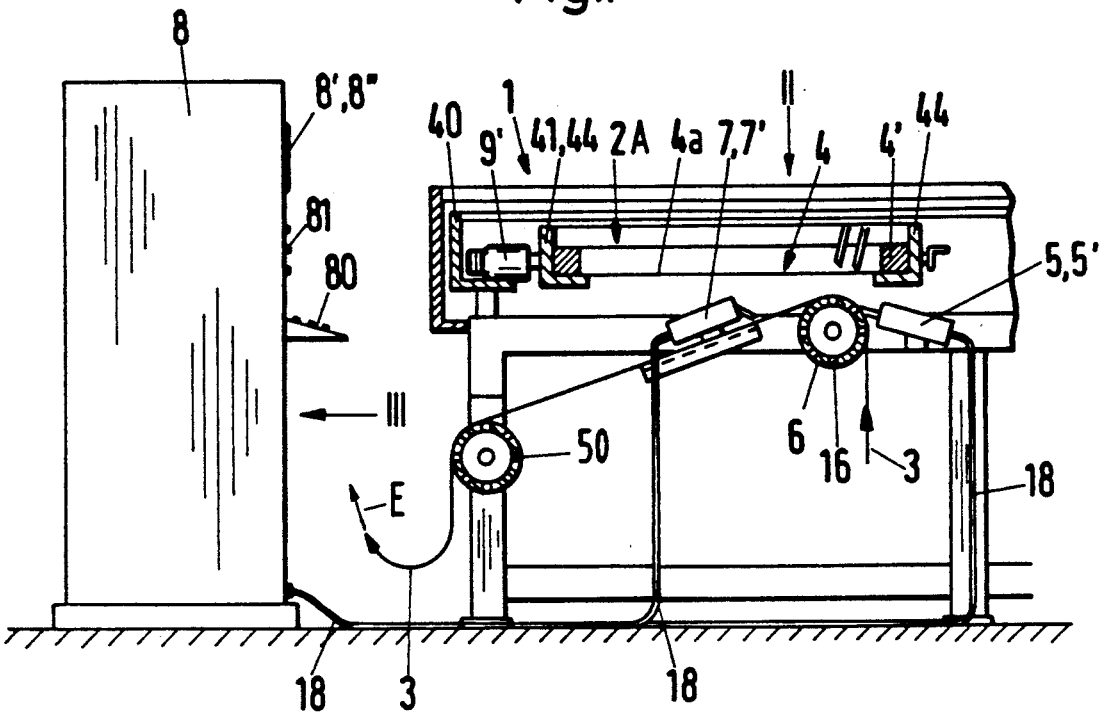
FIG. 1 is a schematic partly elevational and partly longitudinal vertical sectional view of one screen printing unit and of the signal generating and signal evaluating means of a machine which embodies the invention.

The machine 1 comprises web advancing means (note the suction-operated counterpressure cylinder or roller 6 in FIG. 1) for moving the web 3 in a predetermined direction (arrow E) along a predetermined path which extends past the three printing units 2, 2A and 2B. Each printing unit includes two cameras 5, 5' which monitor the web 3 upstream of the respective screen 4a, and two cameras 7, 7' which monitor the web downstream of the respective screen 4a. The cameras 5, 5' are mounted in parallelism with each other (FIGS. 4 and 5) ahead (upstream) of the respective counterpressure cylinder 6 which has suction ports 16 and is installed beneath the respective screen 4a. Each screen 4a forms part of a screen assembly 4 which further includes a frame 4' mounted in and movable by a moving means in the form of a carriage 44 in a support 40. The carriage 44 is movable in directions which are indicated by arrows A, B, C and D (FIG. 4), namely in a first direction (A) coinciding substantially or exactly with the predetermined direction E, in a second direction (B) substantially counter to the predetermined direction E, and in at least one third direction (C or D) substantially transversely of the predetermined direction E. The means for adjusting the carriage 44 relative to the support 40 comprises three electric motors 9, 9', 9'' (e.g., stepping motors) which are mounted in or on the support 40 and have output elements serving to move the carriage in the selected direction. The motor 9 is set up to move the carriage 44 (and hence the respective screen assembly 4 including a frame 4' and a screen 4a) in the direction of arrow A, the motor 9' is set up to move the carriage 44 in the direction of arrow B, and the motor 9'' serves to move the carriage 44 in the direction of arrow C or D.

The character 50 denotes a continuously driven suction drum which slips relative to the web 3 and maintains the web under tension downstream of the respective cylinder 6.

The monitoring means including the cameras 5, 5' serves to ensure proper positioning of a screen 4a relative to the web 3 in the respective printing unit 2, 2A or 2B for the application of ink through the respective screen 4a. The means for applying ink includes one or more squeegees which are not shown in the drawing. Reference may be had, for example, to the aforementioned commonly owned U.S. Pats. Nos. 4,510,864 and 4,964,335 and/or to commonly owned U.S. Pat. No. 4,589,336 granted May 20, 1986 for "Screen printing method and apparatus" and/or to commonly owned U.S. Pat. No. 4,628,814 granted Dec. 16, 1986 for "Flat screen printing machine". The cameras 7, 7' downstream of each screen 4a serve to generate signals which denote the position of freshly applied printed matter.

Figure 3:
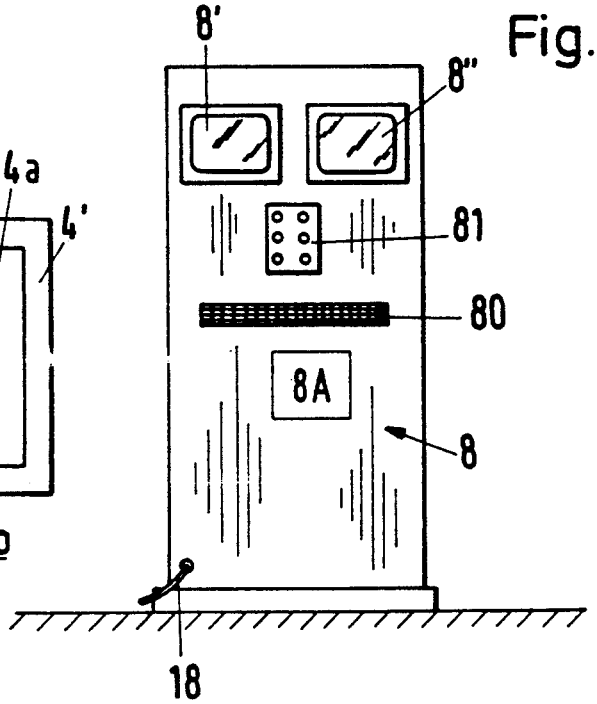
FIG. 3 is a front elevational view of the evaluating means as seen in the direction of arrow III in FIG. 1.

Signals from the cameras 5, 5', 7, 7' at each of the three printing units 2, 2A, 2B are transmitted to the corresponding inputs of an evaluating means here shown as including or constituting a computer 8 (FIGS. 1 and 3). The cameras 7, 7' at each of the three printing stations are adjacent each other (see FIGS. 4 and 5), preferably at the same level.

The computer 8 comprises a signal comparing stage or circuit 8A which compares signals from the cameras 5, 5', 7, 7' with reference signals denoting the optimum positions of passer marks and applied printed matter, and the circuit 8A transmits (when necessary) signals to one or more motors 9, 9', 9'' in order to correct the positions of the screens 4a relative to the web 3 if the characteristics of signals from one or more cameras depart or deviate from the corresponding reference signals. Reference signals can be introduced by way of an input unit 80 in the form of a keyboard or the like.

The computer 8 cooperates with the cameras 5, 5', 7, 7' and with the motors 9, 9', 9'' to ensure that the position of a screen 4a is corrected if the monitoring step indicates a departure of the position of applied printed matter from an optimum position. This ensures that the next application of printed matter will be carried out with the desired or required degree of accuracy irrespective of whether the cameras monitor passer marks or any other suitable information on the web 3.

The illustrated computer 8 is further provided with two screens 8' and 8'' serving to display information which is supplied by the cameras 5, 5', 7, 7' and/or other information, e.g., the extent of deviation of detected position of applied printed matter from the desired position. The reference characters 18 denote electric cables or other suitable conductors which serve to transmit signals from the cameras 5, 5', 7, 7' to the corresponding inputs of the computer 8 and to transmit signals from the computer to the motors 9, 9', 9''. The cables 18 can be omitted if the machine 1 is provided with means for wireless transmission of signals between the cameras and the computer on the one hand, and between the computer and the motors on the other hand.

If the motors 9, 9', 9'' are stepping motors, they can be designed to perform, for example, one thousand steps per revolution. This ensures that the adjustments in the position of a screen 4a can be carried out with the required degree of accuracy. As mentioned above, the motors 9, 9' are designed to advance the respective screens 4a in the directions of arrows A and B, respectively, and each motor 9" is set up to adjust the respective screen 4a in the direction of arrow C or D. These motors can be fixedly secured to the respective supports 40 and respond to signals from the circuit 8A of the computer 8 in order to effect (when necessary) appropriate adjustments of the adjacent carriages 44 (and screens 4a) relative to the respective supports 40. A screen 4a can be adjusted prior or subsequent to each and every printing operation in the respective printing unit.

Figure 4:
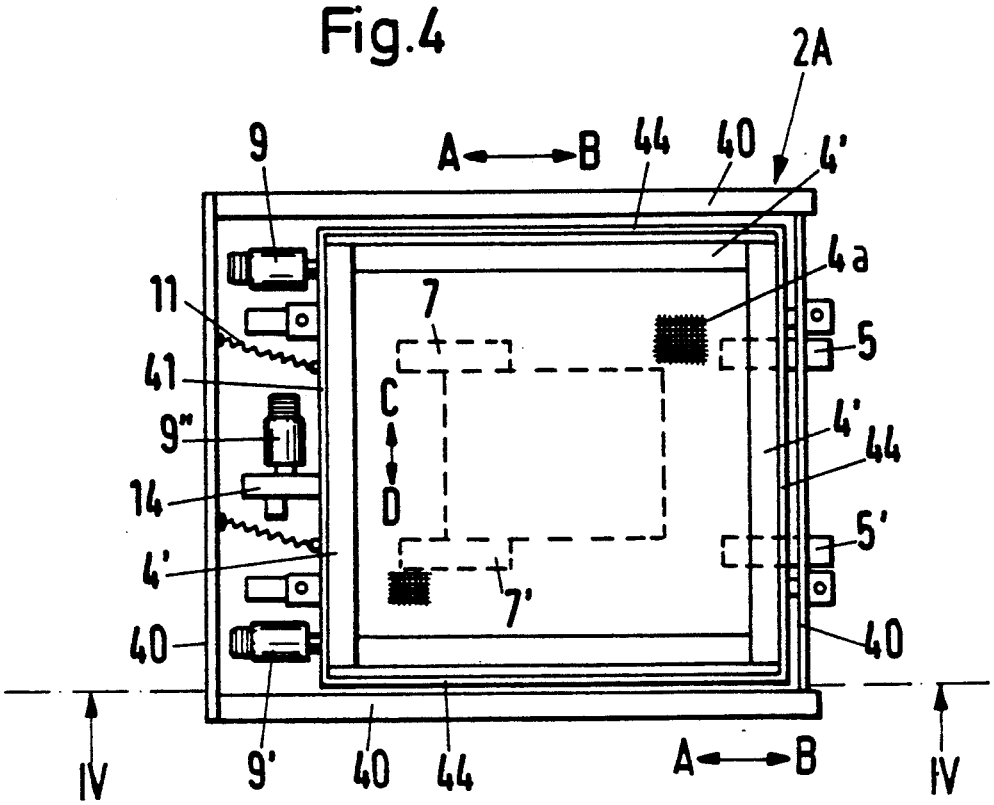
FIG. 4 is another plan view showing the screen of FIG. 2, the carriage for the frame which surrounds the screen, the support for the carriage, and the motors of the adjusting means for the carriage.

FIG. 4 shows coil springs 11 which serve to bias the carriage 44 of the printing unit 2A against the output elements of the adjusting motors 9, 9' and 9" with a constant force. The carriage 44 has an extension 14 which is connected to the output element of the motor 9". The springs 11 cooperate with the motor 9" and/or with the motors 9, 9' to change the orientation of the respective screen 4a in its plane, i.e., to turn the screen (when necessary) in order to achieve a desired adjustment prior to next application of printed matter to that portion of the web 3 which is located at the printing unit 2A. Furthermore, the springs 11 ensure that each and every step of a motor is effective to change the position and/or orientation of the respective screen 4a in order to compensate for eventual departure of the actual position of the screen from the optimal position for the application of printed matter in the respective printing unit.

As can be seen in FIG. 4, the motors 9 and 9' can cooperate to change the orientation of the respective screen 4a relative to the adjacent portion of the web 3. Thus, the motor 9 can cause the adjacent portion of the carriage 44 to move in the direction of arrow A while the motor 9' simultaneously causes the adjacent portion of the carriage 44 to move in the direction of arrow B.

In lieu of controlling the motors 9, 9', 9" in dependency upon signals from the cameras 5, 5', 7, 7', the computer 8 can also serve to adjust the positions of the screens 4a by way of the respective sets of motors 9, 9', 9" in dependency on information which was supplied via keyboard 80 and is stored in the memory of the computer. The latter can also control the angular displacements of the corresponding counterpressure cylinders 6. Such mode of operation can be resorted to in order to compensate for certain variables, such as shrinkage or stretching of the web 3. The screen 4a at each of the printing stations is adjusted prior to the actual printing step. The just discussed mode of operation will be understood with reference to FIG. 2 which shows the screen 4a and the frame 4' of a screen assembly 4. The character a denotes a dimension (e.g., 299 mm) of the area to be printed. The width of the pattern exceeds the dimension a (e.g., by 1 mm) and, therefore, extends into the area b. In other words, the so-called differential value or development error is 1 mm. Such differential value is ascertained, and a corresponding signal is stored. The cylinder 6 is connected with a pulse generator which is designed to transmit a certain number of pulses per unit length, e.g., one pulse per 10 mm. Thus, the cylinder 6 continues to turn in order to move the web 3 through a distance of 1 mm in the direction of arrow A or B, namely after 10 mm through $1/300 \times 10 = 0.033$ mm. Such additional movements with the aforementioned degree of precision can be carried out solely by resorting to a computer. The requisite information is obtained by making and measuring a test print and is fed prior to start of a series of printing operations. This is of particular importance in connection with screen printing which must be carried out with an extremely high degree of precision. Examples of operations which must be carried out with such degree of precision are those which are necessary in connection with the making of printed circuit boards.

Figure 2:
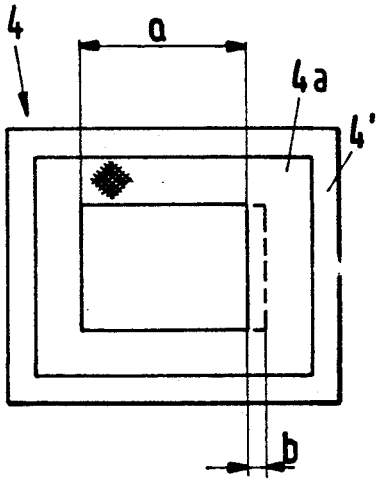
FIG. 2 is a schematic plan view of a screen in the printing unit substantially as seen in the direction of arrow II in FIG. 1.

Correction of the nature discussed in connection with FIG. 2 is desirable in order to compensate for improper positioning of the counterpressure cylinder 6 at a particular printing station. Such improper positioning should be compensated for before the application of printed matter begins. The aforediscussed differential value denotes the difference between the position of the pattern and the actual print. The difference can be a positive or a negative difference, and a corresponding signal is transmitted to the computer. The pulse generator which controls the cylinder 6 ensures uniform distribution of such differential value over the entire imprint. For example, if the differential value is +0.10 and the pulse generator transmits ten pulses per imprint, each correction amounts to 0.01 mm per pulse. Reference may be had to the aforementioned U.S. Pat. No. 4,249,688 which fully discloses the pulse generator and the motor or motors which can drive a suction-operated counterpressure cylinder in order to compensate for differential values or development errors.

When a fresh length of a web 3 reaches a printing station, such as the station for the first printing unit 2 of FIG. 5, the corresponding cameras 5, 5' transmit signals denoting the positions of passer marks prior to start of the printing operation, and the cameras 7, 7' monitor the passer marks upon completion of the printing step. The cameras 5, 5' are optional but desirable. The printing operation in the first unit 2 can merely involve detection of passer marks and a determination (such as on the basis of the aforementioned test print) of the aforediscussed differential value. The information which is obtained at the station for the unit 2 is thereupon utilized to properly position (if necessary) the screen 4a in the printing unit 2A. Such mode of operation ensures that the application of printed matter by the unit 2A is completed with a high degree of accuracy by full compensation for eventual misalignments which are detected at the station for the unit 2. This greatly reduces the number of rejects. The same procedure is repeated at the station for the unit 2B except that the making of a test print is not necessary, the same as in the unit 2A. The information which is ascertained by the cameras 5, 5', 7, 7' at the station for the printing unit 2A is processed by the computer 8 which transmits signals for adjustment of the screen 4a at the station for the unit 2B if such adjustment is necessary.

The aforediscussed mode of adjusting the screen 4a in a printing unit can be relied upon with equal or similar advantage in screen printing machines which employ a single printing unit, i.e., wherein a web is caused to repeatedly advance through one and the same printing unit. With reference to FIG. 4, this merely involves the establishment of an endless path along which a web 3 is advanced to repeatedly move its increments past one and the same screen 4a.

FIG. 5 further shows that the improved machine 1 can be equipped with means for coupling two or more carriages 44 for screens 4a to ensure simultaneous adjustments of such screens. The coupling means of FIG. 5 comprises an elongated displacing member 13 in the form of a rod or bar which is connected with the supports 40 or with the carriages 44 at the stations for the printing units 2, 2A and 2B. The displacing member 13 receives motion from the link 12 of a crank drive which is driven by a motor 112 also serving to rotate the cylinders 6 through freewheel clutches, preferably in a manner as disclosed in the aforementioned U.S. Pat. No. 4,249,688. It is equally possible to employ an eccentric drive or any other means for moving the displacing member 13 with the required degree of precision. The arrangement is such that each of the three screens 4a which are shown in FIG. 5 is individually adjustable by the corresponding set of motors 9, 9' and 9".

The coupling system 12, 13 of FIG. 5 contributes to predictability of operation of the screen printing machine.

The improved screen printing machine is susceptible of many additional modifications without departing from the spirit of the invention. For example, each printing station can accommodate a single camera (5 or 5') ahead of and/or a single camera (7 or 7') downstream of the respective screen 4a. The utilization of pairs of cameras is preferred when the position of a screen is to be adjusted with a very high degree of accuracy because pairs of cameras render it possible to detect inaccurate orientation of the respective screens.

It is further possible to provide one or more web drying stations between the printing units 2, 2A, 2B of FIG. 5.

The computer 8 can be a commercially available evaluating unit. The provision of one or more displaying means 8', 8" constitutes an optional feature of the computer. The reference character 81 denotes in FIG. 3 an indicator which monitors the controls for activation of the cameras and/or motors but can also serve to control or monitor the operation of certain other components of the screen printing machine.

It is also within the purview of the invention to use an adjustable screen only at the second, third, etc. station of a machine which applies printed matter at two or more successive stations. Thus, the motors and the cameras at the station for the printing unit 2 of FIG. 5 can be omitted.

The accuracy of the printing operation will depend also upon the nature of the computer which is used to transmit signals to the motors. Furthermore, the desired degree of accuracy will determine whether or not it is necessary to employ an adjustable screen 4a at the first of a series of two, three or more successive printing stations. It is also possible to employ a discrete computer for each of two or more printing units. All that counts is to ensure that, by utilizing one or more cameras and one or more motors with one or more computers, the improved machine is capable of applying printed matter with a degree of accuracy which cannot be achieved with heretofore known screen printing machines. The improved machine is not dependent upon the extent and/or nature of advancement of the web 3 and/or upon the unpredictabilities of certain characteristics of the web. Thus, the machine can compensate for all such unpredictabilities to ensure that the distribution of printed matter on the finished product matches the desired or optimal distribution with a heretofore unachievable degree of accuracy.

The downstream camera or cameras 7, 7' are desirable and advantageous because they furnish to the computer 8, or to the respective computers, information concerning the applied printed matter. Thus, such cameras can ensure that the number of rejects is reduced to a minimum because the computer or computers can compensate for improper application of printed matter at the station where the respective cameras 7, 7' are located as well as at the next-following station (if any). The cameras 7, 7' at the last station are optional and are preferably provided only to make sure that the corresponding unit 2B can be installed at any desired location, e.g., at the locus of the unit 2 or 2A. In addition, the cameras 7, 7' at the station for the unit 2B can be used to enable the computer to furnish information denoting the application of printed matter by the unit 2B and/or to adjust the screen 4a of the unit 2B (if and when necessary) in order to avoid repetition of improper application of printed matter at the last station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A screen printing machine comprising means for advancing a web of a material to be printed in a predetermined direction along a predetermined path; at least one printing unit including a screen adjacent a predetermined portion of said path and located at one side of such path, means for applying to the advancing web ink by way of such screen, and adjustable moving means for moving said screen relative to said path in at least one of a plurality of different directions including a first direction substantially coinciding with said predetermined direction, a second direction substantially counter to said predetermined direction and at least one third direction substantially transversely of said predetermined direction; first signal generating means including at least one camera having means for monitoring at least one of a plurality of parameters including the positions of passer marks, if any, on the web relative to said path and the position of ink on the web and for generating first signals denoting the at least one parameter; second signal generating means including means for evaluating first signals from said monitoring means and for generating second signals; and means for adjusting said moving means in response to said second signals.

2. The machine of claim 1, wherein said monitoring means includes a plurality of cameras and said adjusting means comprises at least one motor.

3. The machine of claim 1, wherein said evaluating means comprises a computer.

4. The machine of claim 1, further comprising at least one additional printing unit adjacent a second portion of said path upstream of said predetermined portion, said at least one camera being disposed downstream of said predetermined portion of said path.

5. The machine of claim 4, wherein said at least one camera is disposed between said predetermined portion and said second portion of said path.

6. The machine of claim 4, wherein said at least one camera is disposed downstream of said second portion of said path.

7. The machine of claim 1, wherein said at least one printing unit further comprises a frame for said screen and said moving means includes a mobile carriage for said frame.

8. The machine of claim 1, further comprising at least one additional unit adjacent a second portion of said path upstream of said predetermined portion, and means for coupling the moving means of said units for simultaneous movements of the screens of said units relative to said path.

9. The machine of claim 8, wherein said coupling means comprises a support for each of said moving means, a displacing member connecting said supports to each other, and means for shifting said displacing member at least in or counter to said predetermined direction.

10. The machine of claim 9, wherein said shifting means comprises a crank drive.

11. The machine of claim 1, wherein said at least one camera is adjacent said path upstream of said predetermined portion.

12. The machine of claim 1, wherein said at least one camera is adjacent said path downstream of said predetermined portion.

13. The machine of claim 1, wherein said at least one unit further comprises a frame for said screen and said moving means comprises a mobile carriage for said frame, said adjusting means including a plurality of motors having output elements connected with said carriage.

14. The machine of claim 1, wherein said adjusting means comprises a first motor having means for adjusting said moving means in said first direction, a second motor having means for adjusting said moving means in said second direction, and a third motor having means for adjusting said moving means in said at least one third direction.

15. The machine of claim 14, wherein said moving means includes an extension which is connected with the adjusting means of said third motor.

16. The machine of claim 1, wherein said evaluating means comprises means for comparing first signals from said monitoring means with reference signals and for generating signals for transmission to said adjusting means when the characteristics of first signals from said monitoring means deviate from the characteristics of said reference signals.

17. The machine of claim 16, wherein said adjusting means includes a motor having means for adjusting said moving means in said first direction and a motor having means for adjusting said moving means in said second direction.

18. The machine of claim 1, further comprising means for biasing said moving means against said adjusting means.

19. The machine of claim 1, wherein said moving means includes means for changing the orientation of said screen relative to said predetermined portion of said path.

20. The machine of claim 19, wherein said screen is disposed in a predetermined plane and said orientation changing means includes means for angularly moving said screen in said plane.

* * * * *